US008389903B2

(12) United States Patent
Schmidt

(10) Patent No.: US 8,389,903 B2
(45) Date of Patent: Mar. 5, 2013

(54) ELECTROTHERMAL FOCUSSING FOR THE PRODUCTION OF MICRO-STRUCTURED SUBSTRATES

(75) Inventor: Christian Schmidt, Bouveret (CH)
(73) Assignee: picoDrill SA, Lausanne (CH)

( * ) Notice: Subject to any disclaimer, the term of this patent is extended or adjusted under 35 U.S.C. 154(b) by 279 days.

(21) Appl. No.: 12/741,734

(22) PCT Filed: Nov. 7, 2008

(86) PCT No.: PCT/EP2008/009419

§ 371 (c)(1),
(2), (4) Date: Jul. 23, 2010

(87) PCT Pub. No.: WO2009/059786

PCT Pub. Date: May 14, 2009

(65) Prior Publication Data

US 2010/0276409 A1 Nov. 4, 2010

Related U.S. Application Data

(60) Provisional application No. 60/996,287, filed on Nov. 9, 2007.

(51) Int. Cl.
*B26F 1/28* (2006.01)

(52) U.S. Cl. ..... 219/162

(58) Field of Classification Search ..... 219/50, 219/69.1, 157, 162, 385; 257/202, E21.327, 257/E29.166, 618, E23.179; 438/466; 428/131, 428/456; 264/405, 482; 425/174.6
See application file for complete search history.

(56) References Cited

U.S. PATENT DOCUMENTS 4,777,338 A * 10/1988 Cross ..... 219/69.1
6,348,675 B1 2/2002 Takagi

FOREIGN PATENT DOCUMENTS

WO WO 2005/097439 10/2005
WO WO2005/097439 * 10/2005
WO WO 2009059786 A1 * 5/2009

OTHER PUBLICATIONS

International Search Report for International Patent Application No. PCT/EP2008/009419 dated Apr. 9, 2009.

* cited by examiner

*Primary Examiner* — Dao H Nguyen
*Assistant Examiner* — Tram H Nguyen
(74) *Attorney, Agent, or Firm* — Pearl Cohen Zedek Latzer, LLP

(57) ABSTRACT

The invention relates to methods and devices for the production of micro-structured substrates and their application in natural sciences and technology, in particular in microfluidic and analysis devices and provides a method of introducing a structure, preferably a hole or cavity or channel or well or recess, in a region of an electrically insulating substrate (s), said method comprising the steps: a) providing an electrically insulating substrate (s), b) storing electrical energy across said substrate using an energy storage element (c) which is charged with said electrical energy, said energy storage element being electrically connected to said substrate, said electrical energy being sufficient to significantly heat, and/or melt and/or evaporate parts or all of a region of said substrate, c) applying additional energy, preferably heat, to said substrate or a region thereof to increase the electrical conductivity of said substrate or said region thereof, and thereby initiate a current flow and, subsequently, a dissipation of said stored electrical energy within the substrate and d) dissipating said stored electrical energy, wherein the rate of dissipating said stored electrical energy is controlled by a current and power modulating element, said current and power modulating element being part of the electrical connection between said energy storage element and said substrate. A device for performing the method is also provided.

54 Claims, 7 Drawing Sheets

A

B

A

A

B

A

B

C

ELECTROTHERMAL FOCUSSING FOR THE PRODUCTION OF MICRO-STRUCTURED SUBSTRATES

CROSS-REFERENCE TO RELATED APPLICATIONS

Figure 1:
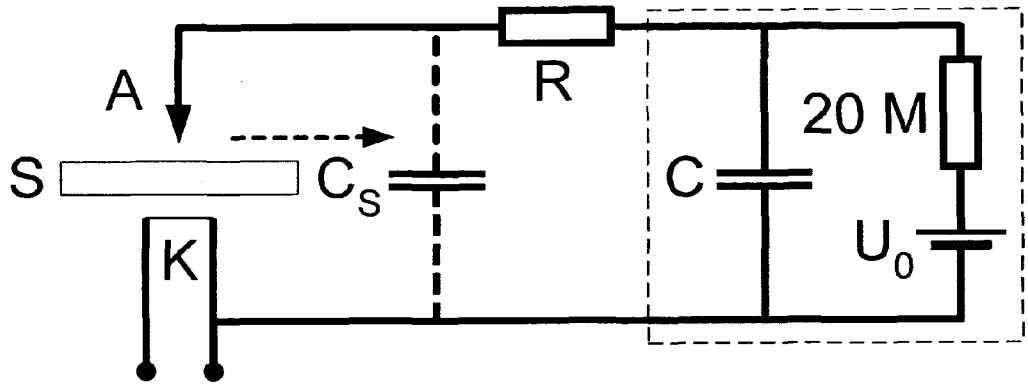
Figure 1:
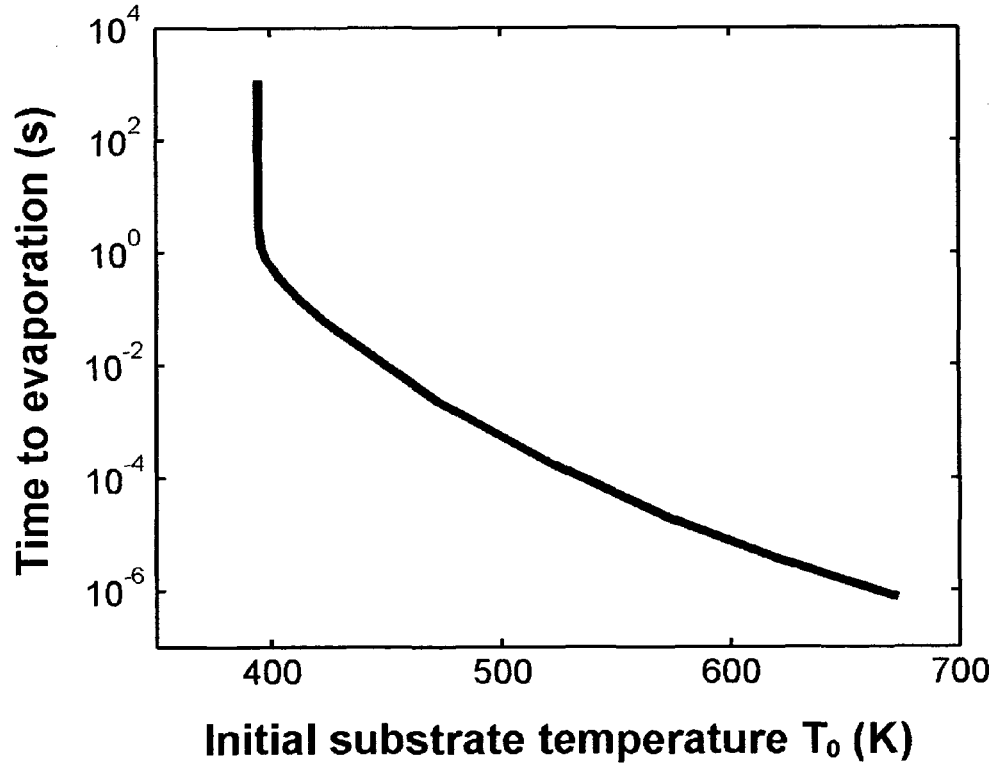

This application is a National Phase Application of PCT International Application No. PCT/EP2008/009419, International Filing Date 7 Nov. 2008, claiming priority of U.S. Provisional Patent Application No. 60/996,287, filed 9 Nov. 2007.

FIELD OF THE INVENTION

This invention relates to methods and devices for the production of micro-structured substrates and their application in natural sciences and technology, in particular in microfluidic and analysis devices.

BACKGROUND OF THE INVENTION

Many miniaturized fluidic and chemical/biological analysis devices require small reservoirs and connection channels. The dimensions of these channels and containers are often in the micrometer range. Common micromaching techniques, developed mostly for planar structures, fall short of making wells and channels which enter deep into the chip/substrate. That is, the achievable aspect ratio—the ratio between the length and the diameter of a hole, is limited to typically 1:10. This is in particular true for the machining of glass and glass like materials such as fused silica. Significant drawbacks for large scale application derive also from the high production cost.

On the other hand, channels with very high aspect ratio allow for efficient electro-osmotic pumping of fluids through these channels, requiring e.g. for channels of 150 um length and 2 um diameter only small voltages and currents (e.g. 5 V) for significant fluid velocities within the channel. Very high aspect ratios will also allow to connect both sides of a typical glass chip of e.g. 0.5 mm thickness by trans-chip channels, thereby enabling simple three-dimensional fluid designs.

Channels with picoliter capacities will also provide a basis for picoliter fluidics, utilizing fluid transport and mixing effects irrelevant in larger volumes.

Accordingly it was an object of the present invention to provide for a method allowing the production of high quality perforated substrates. It was also an object of the present invention to provide for a method of production of such high quality membrane carriers which method is easy to perform and reproducible. It was furthermore an object to provide for a method allowing the controlled production of holes, cavities or channels in substrates, wherein the geometrical features of the holes, cavities and channels can be easily controlled and influenced. It was also an object of the present invention to provide for a method allowing the mass production of perforated substrates. It was furthermore an object of the present invention to provide a method of hole production that can be applied to substrates that were hitherto difficult to process, such as glass.

SUMMARY OF THE INVENTION

All the objects are solved by a method of introducing a structure, preferably a hole or cavity or channel or well or recess, in a region of an electrically insulating substrate, said method comprising the steps:

a) providing an electrically insulating substrate, b) storing electrical energy across said substrate using an energy storage element which is charged with said electrical energy, said energy storage element being electrically connected to said substrate, said electrical energy being sufficient to significantly heat, and/or melt and/or evaporate parts or all of a region of said substrate, c) applying additional energy, preferably heat, to said substrate or a region thereof to increase the electrical conductivity of said substrate or said region thereof, and thereby initiate a current flow and, subsequently, a dissipation of said stored electrical energy within the substrate, and d) dissipating said stored electrical energy, wherein the rate of dissipating said stored electrical energy is controlled by a current and power modulating element, said current and power modulating element being part of the electrical connection between said energy storage element and said substrate.

It should be noted that step d) occurs automatically as a consequence of the performance of steps b) and c).

In one embodiment step b) is performed by applying a voltage across said region of said substrate by means of a voltage supply and charging said energy storage element with said electrical energy, said energy storage element being electrically connected in parallel to said substrate and said voltage supply, wherein preferably said energy storage element and, preferably also said voltage supply, is connected to said substrate by electrodes, which electrodes either touch said substrate or touch a medium, said medium being in contact with said substrate, wherein said medium is a liquid or gaseous medium which is electrically conducting or can be made electrically conducting, e.g. by ionisation.

Preferably, said energy storage element and said voltage supply are connected to said substrate by the same electrodes.

In one embodiment, the amount of said electrical energy stored across said substrate and charged to said energy storage element is user-defined in relation to substrate parameters, such as substrate area, substrate thickness, and process parameters, such as maximum temperature occurring during step d), wherein, preferably, said amount of electrical energy is in the range of from 1-50000 mJ/mm substrate thickness, preferably 10-5000 mJ/mm substrate thickness.

More preferably, said voltage supply is a high impedance voltage supply, wherein preferably said high impedance voltage supply has an impedance >10 kΩ, more preferably >100 kΩ and, even more preferably >1 MΩ.

In one embodiment, said energy storage element is a low impedance energy storage element, wherein preferably said low impedance is an impedance ≦10 kΩ.

Preferably, upon dissipation of said electrical energy, said voltage supply provides further electrical energy to be stored across the substrate by charging it to said energy storage element, wherein, more preferably, steps b)-d) are repeated at least once, preferably several times, with a user-defined delay after the end of step d) and before performance of a next step b).

In one embodiment, said dissipation of said electrical energy in step d) occurs by an electrical current being supplied from said energy storage element to said substrate and through said region and thereby transforming said electrical energy into heat which heat will heat and/or melt and/or evaporate and/or ablate substrate material in said region, wherein, preferably, said electrical current is supplied to said substrate via said current and power modulating element, said current and power modulating element controlling and/or modulating step d), and thereby controlling the transformation of said electrical energy into heat.

More preferably, said electrical current being supplied to said substrate and subsequently flowing through said substrate in step d) has a temporary maximum of at least 100 mA for substrates of ≧0.1 mm thickness, if introduction of a hole into said substrate is required.

In a preferred embodiment, said dissipation in step d) occurs at a stored electrical energy resulting in a trans-substrate voltage across said substrate of at least 5V/micrometer substrate thickness.

Preferably, said current and power modulating element is an electronic feedback mechanism which, preferably, comprises a current and/or voltage analysis circuit such as a trigger circuit alone or as part of a user programmed device, such as a computer, said current and/or voltage analysis circuit preferably being capable of controlling the trans-substrate voltage and electrical current flow of step d) according to user-predefined procedures, such as steadily reducing or turning off such voltage supply and/or energy storage element output once a user specified trans-substrate current threshold is exceeded.

In one embodiment, said additional energy, preferably heat, originates either from an additional energy source, preferably a heat source, or from performing step b) on said substrate, wherein, preferably, said additional energy source is a heated electrode or a heating element placed near by said substrate or a laser or other focussed light source or a gas flame.

In a preferred embodiment, said current and/or voltage analysis circuit also is capable of controlling said additional energy or heat source, if present.

In a particularly preferred embodiment, said electronic feedback mechanism is an ohmic resistor which is connected in series between said substrate and said energy storage element, wherein, more preferably, said ohmic resistor is chosen such that it has a resistance in the range of from 0.01-100 kΩ if said substrate has a thickness ≧1 μm, and a resistance >100 kΩ if said substrate has a thickness <1 μm.

Preferably, said ohmic resistor is chosen in terms of its resistance such that said resistor leads to a reduction of the trans-substrate voltage of at least a factor of 2, preferably a factor of 5 during step d), compared with otherwise identical conditions but in the absence of a resistor.

In one embodiment, said ohmic resistor is tunable.

In another embodiment, said ohmic resistor has a fixed resistance.

Preferably, said energy storage element and, preferably also said voltage supply, is connected to said substrate by said electrodes via connections, which, with the exception of said ohmic resistor, if present, have a low impedance which low impedance connections are chosen such in terms of their total impedance value that they do not lead to any significant reduction of the trans-substrate voltage during step d), wherein, preferably said low impedance connections have a total impedance value ≦0.01 kΩ

As used herein, a "significant reduction" of the trans-substrate voltage, preferably, is a reduction by >10V, more preferably >100V and even more preferably >500V.

In one embodiment, said current and power modulating element causes an end of step d) within a user-predefined period after onset of step d), said onset preferably being an increase in electrical current, by a factor of 2, preferably by at least one order of magnitude, or a current value >1 mA, preferably >10 mA.

In one embodiment, said energy storage element being electrically connected in parallel to said substrate and said voltage supply is a capacitor or a coil, wherein, preferably, said energy storage element is a capacitor, and wherein, more preferably, said capacitor has a capacity in the range of at least 30 pF/mm substrate thickness.

Even more preferably, said capacitor is connected to said substrate via said current and power modulating element, preferably via said ohmic resistor, such that said electrical energy stored using said capacitor, is dissipated via said current and power modulating element, preferably via said ohmic resistor.

In another embodiment, said energy storage element is an intrinsic or intrinsically forming capacitance of said substrate which is the sole energy storage element present or is present in addition to a capacitor as defined above, wherein, preferably, if said intrinsic or intrinsically forming capacitance of said substrate is the sole energy storage element present, no electrodes connecting said energy storage element to said substrate are present, and step d) is controlled by appropriate selection of the area of said substrate which area is exposed to the surrounding medium, and/or by appropriate selection of the conductive properties of said medium being in contact with said substrate, said medium being responsible for charge carrier transport during said dissipation in step d), said conductive properties of said medium being defined by pressure, temperature, and composition of said medium, said medium thereby functioning as current and power modulating element.

In one embodiment, step b) occurs by the placement of said electrodes at or near said region, preferably by placing one electrode on one side of said substrate and by placing another electrode on another side of said substrate, and by application of said voltage across said electrodes.

In one embodiment, said applied voltage is purely DC.

In another embodiment, said applied voltage is purely AC.

In yet another embodiment, said applied voltage is a superposition of AC and DC voltages.

Preferably, the frequency of said applied AC voltage is in the range of from $10^2$ to $10^{12}$ Hz, preferably in the range of from $5\times10^2$ to $10^8$ Hz, more preferably $1\times10^3$ to $1\times10^7$ Hz.

In one embodiment, said AC voltage is applied intermittently, preferably in pulse trains of a duration in the range of from 1 ms to 1000 ms, preferably 10 ms to 500 ms, with a pause in between of a duration of at least 1 ms, preferably of at least 10 ms.

Preferably, said applied AC voltage is used for performing step c).

In one embodiment, said applied AC voltage has parameters e.g. amplitude, frequency, duty cycle which are sufficient to establish an electric arc between a surface of said substrate and said electrodes, wherein, preferably, said electric arc is used for performing step c).

Preferably, said applied AC voltage leads to dielectric losses in said region of said substrate, said dielectric losses being sufficient to increase the temperature of said region.

In one embodiment, the frequency of said applied AC voltage is increased to reduce deviations of the current path from a direct straight line between the electrodes.

In one embodiment, the frequency of said applied AC voltage is increased to minimize the possible distance between neighbouring structures, preferably neighbouring holes.

In one embodiment, in step c), heat is applied to said region of said substrate using a heated electrode or a heating element placed near by the electrode, wherein, preferably, said heated electrode is an electric heating filament and is also used to apply said voltage to said region in step b).

In one embodiment, in step c), heat is applied to said region of said substrate additionally or only by using an external heat source, such as a laser or other focussed light source, or by using a gas flame.

In one embodiment, in step c), heat is applied to said region of said substrate by applying an AC voltage to said region, wherein, preferably, said AC voltage is applied to said region by said electrodes placed on opposite sides of said substrate, preferably at least one electrode being placed on one side of said substrate and at least one electrode being placed on another side of said substrate, and wherein, more preferably, said electrodes placed on opposite sides of said substrate are also used for performing step b).

Even more preferably, said AC voltage is in the range of $10^3$ V-$10^6$ V, preferably $2\times10^3$V-$10^5$ V, and has a frequency in the range of from $10^2$ Hz to $10^{12}$ Hz, preferably in the range of from $5\times10^2$ to $10^8$ Hz, more preferably $1\times10^3$ to $1\times10^7$ Hz.

In one embodiment, said structure being formed is a hole having a diameter in the range of from 0.01 μm to 200 μm, preferably 0.05 μm to 20 μm.

In another embodiment, said structure being formed is a cavity having a diameter in the range of from 0.1 μm to 100 μm.

In one embodiment, the dimensions of the structure formed are solely determined by the electrical parameters, such as amount of stored electrical energy, electrical current being supplied to said substrate during dissipation of said electrical energy, and current and power modulating element, and by the material parameters, such as the material of the electrically insulating substrate and its electrical conductivity at ambient conditions, whereas the dimensions of the structure are independent of the additional energy or heat source and its parameters. Consequently such additional energy or heat source has to fulfil only minimum requirements, namely that it be capable of raising the electrical conductivity of the substrate locally. Due to the self-focussing nature of the dissipation process in step d), the dimensions of the structure are therefore only dependent on the electrical parameters and the material parameters and not on the additional heat or energy source, provided that such heat or energy source is capable of raising the electrical conductivity of the substrate locally. However, such local increase in electrical conductivity does not finally determine the dimensions of the structure formed.

In one embodiment, said voltage is applied by electrodes placed on opposite sides of said substrate, and said structure being formed is a channel-like structure obtained by a relative movement of said electrodes in relation to said substrate.

In one embodiment, said electrically insulating substrate is selected from a group comprising carbon-based polymers, such as polypropylene, fluoropolymers, such as Teflon, silicon-based substrates, such as glass, quartz, silicon nitride, silicon oxide, silicon based polymers such as Sylgard, semiconducting materials such as elemental silicon.

In one embodiment, said region where a structure is to be formed, has a thickness in the range of from $10^{-9}$ m to $10^{-2}$ m, preferably $10^{-7}$ m to $10^{-3}$ m, more preferably $10^{-5}$ m to $5\times10^{-4}$ m, most preferably $>10^{-6}$ m.

In one embodiment, said substrate is provided in step a) within a medium (solid, liquid or gas) that reacts with a surface of said substrate during steps b), c) and/or d).

The objects of the present invention are also solved by a device for performing the above method according to the present invention comprising:

a voltage supply, an energy storage element electrically connected in parallel to said voltage supply, means to receive and hold an electrically insulating substrate in a defined place while a structure is being formed in a region of said substrate, at least two electrodes electrically connected to said voltage supply and said energy storage element, said at least two electrodes being positioned such that, if an electrically insulating substrate is present in said defined place, said electrodes either touch said substrate or touch a medium, said medium being in contact with said substrate, wherein said medium is a liquid or gaseous medium which is electrically conducting or can be made electrically conducting, e.g. by ionisation, a current and power modulating element, said current and power modulating element being part of the electrical connection between said energy storage element and said electrodes, means to apply energy, preferably heat, to said substrate, wherein said means is one electrode or said at least two electrodes or is an additional heat source, wherein, preferably, said voltage supply, said energy storage element, said at least two electrodes, said medium, said current and power modulating element, and said means to apply energy are as defined above.

Preferably, said means to receive and hold an electrically insulating substrate are fixing means such as a holder, a resting surface, a clamp, a pin and socket, a recess for receiving said substrate, and any combination of such fixing means including several pins, several recesses and the like.

In a preferred embodiment, the device according to the present invention further comprises an electrically insulating substrate, said electrically insulating substrate being as defined above.

The inventors have surprisingly found that it is possible to create high aspect ratio micro-structures such as holes in a dielectric substrate and controlling such process with high accuracy, by storing a defined amount of electrical energy across the substrate using an energy storage element and a voltage source, wherein the energy storage element may for example be a capacitor being connected in parallel to the substrate and the voltage source, and dissipating such stored electrical energy in a controlled manner via a current and power modulating element, which may, in the simplest case be an ohmic resistor electrically connected in series between the substrate and the energy storage element. The power modulating element controls the current flowing through said substrate during the dissipation step and thereby also the trans-substrate voltage, as a result of which the local heat production in the substrate is controlled during the dissipation step, and thereby also effectively the size of the structure thus formed is controlled. Because the amount of energy stored across the substrate is finite, due to the finite capacity of the energy storage element, and because the energy storage element has a low impedance, the electrical energy can be dissipated extremely fast. Because it is finite, the entire process of dissipation is ended abruptly and very fast, in the order of nanoseconds or even below. The voltage supply itself has very little or no influence on the size of the microstructure, whereas this size is only determined by the dissipation rate, the amount of electrical energy stored, the voltage change over time during dissipation U(t), the qualities of the substrate material such as substrate conductivity σ(T) and possibly the medium in contact with the substrate.

It should also be noted that the dimensions of the structure (hole, cavity, channel etc.) formed or introduced in said substrate are solely determined by the electrical parameters, such as amount of stored electrical energy, electrical current being supplied to said substrate during dissipation of said electrical energy, and current and power modulating element, and by the material parameters, such as the material of the electrically insulating substrate and its electrical conductivity at ambient conditions, whereas the dimensions of the structure are independent of the additional energy or heat source and its parameters. Consequently such additional energy or heat source has to fulfil only minimum requirements, namely that it be capable of raising the conductivity of the substrate locally. Due to the self-focussing nature of the dissipation process in step d), the dimensions of the structure are therefore only dependent on the electrical parameters and the material parameters and not on the additional heat or energy source, provided that such heat or energy source is capable of raising the electrical conductivity of the substrate locally. It should also be noted that such local increase in electrical conductivity does not finally determine the dimensions of the structure formed.

Using the method according to the present invention, structures may be formed having dimensions in the μm range or even below.

More specifically, using the method and the device according to the present invention, the controlled formation of holes 0.1-10 μm in diameter with aspect ratios ≦330 has been achieved in amorphous dielectrics, such as glass and fused silica, by fast resistive heating. A strongly focussed hyper-exponential temperature increase inside the dielectric led to fast material melting and evaporation. Time intervals between melting and evaporation were estimated $\sim 10^{-11}$ s with power densities reaching 100 W/μm$^3$. The hole size was a function of the substrate conductivity σ(T) and the applied voltage U(t) and characterized by a high reproducibility. The exemplary application of large aspect ratio holes in electroosmotic pumps and low noise ion channel measurements was demonstrated.

As used herein, the term "energy storage element" refers to a device or structure or apparatus which allows to store electrical energy in it which energy can subsequently be regained, if and where needed. In the method and device according to the invention, usually this "energy storage element" is electrically connected to the substrate in parallel such that, effectively, any electrical energy stored in said energy storage element is also stored "in" or "across" said substrate. Usually electrical energy is stored in such an energy storage element by charging said energy storage element with electrical energy obtained from a common energy source such as a commercially available voltage supply. It should be noted that an "energy storage element" according to the present invention has a low impedance, typically ≦10 kΩ. Because of the low impedance of the energy storage element, the characteristics of the voltage supply used to charge the energy storage element do not play a role anymore for the subsequent process of regaining the energy from the energy storage element, and therefore the energy stored in such an energy storage element can be discharged at high voltages (in the order of 10 kV and above) and high current values in the order of (100 mA to 10 A). The process of discharging said electrical energy from said energy storage element is herein also referred to as "dissipating said electrical energy". As used herein, such "dissipating" of electrical energy is effectively the transformation of electrical energy into heat. Typical examples of an energy storage element according to the present invention are a capacitor or a coil.

The rate of dissipation of the electrical energy is controlled by a "current and power modulating element" which typically is a device, structure or apparatus that is in the connection between the energy storage element and the substrate, and therefore any electrical energy that is dissipated from said energy storage element as an electrical current flowing into and through the substrate, is dissipated via such "current and power modulating element". Consequently such "current and power modulating element" allows to control the current flow as well as the trans-substrate voltage. In the simplest case, such current and power modulating may be an ohmic resistor between said energy storage element and said substrate.

Under some circumstances the energy storage element may also be an intrinsically forming capacitance of the substrate, which may play a role if the substrate has a thickness <50 μm and which forms if, due to the application of a voltage across said substrate, the gaseous medium around the substrate in the boundary layer becomes ionised. Here such capacitance may also be used as an energy storage element, in addition to an "external" energy storage element, such as a capacitor, or also as the sole energy storage element. If this intrinsic capacitance is the sole energy storage element, the rate of dissipation of said energy may be controlled by limiting the area exposed to said medium, thereby effectively limiting the amount of energy stored in said capacitance, and by influencing the pressure, composition and temperature of the medium. In the latter case, effectively the surrounding medium is used as current and power modulating element.

As used herein, the term "to significantly heat" a substrate means a process whereby the temperature of the substrate is increased by at least 30 K.

In the following reference is made to the figures which show the following:

FIG. 1

(A) Experimental Setup. The substrate S was placed between two electrodes A and K, the latter being prepared as heating filament (≈1 mm$^2$, distance ≈100 μm, T≈1200 K). A high impedance generator charged the capacitor C (50-470 pF) providing a low impedance voltage source and inherent energy limitation ($CU_O^2/2 \approx 1$-450 mJ) to the process. The maximum substrate current was controlled by R. Voltage-dependent polarisation of the dielectric substrate material formed an additional 'parasitic' capacitance $C_S$. (B) Relation between initial substrate temperature $T_0$ and time to reach evaporation $t_{evap}$. As $T_0$ exceeds a threshold, $\sigma E^2$ becomes sufficient for self-sustained field induced heating (26). Heat dissipation inside the heated region (radius $r_c$) and conduction into the surrounding (radial distance l) were approximated with $P_{in}=\sigma(T)E^2\pi r_c^2 h$ and $P_{out}=\lambda 2\pi r_c h\Delta T/l$ (27). The relation $P_{in}>P_{out}$ was used to estimate the threshold $T_0>452$ K ($U_0=10$ kV, $r_c=l=100$ μm).

FIG. 2

Simulated progression of temperature and power dissipation in the substrate centre ($U_0=10$ kV, h=150 μm). (A) Positive feedback between T and a results (after a slow onset) in an extremely fast heating with a delay between substrate melting and evaporation of $\approx 10^{-11}$ s (R=0). Raising R lowers temperature growth. For $R \ll R_S$ (slow onset) power dissipation is determined by $R_S$. For $R_S$ approaching R (roughly indicating the onset of hyper-exponential growth) the series resistance limits significantly power dissipation and dT/dt. The time scale corresponds with the observed substrate current increase (upper trace, R=10 kΩ). (B) Power density distribution shown at consecutive times Δt=62 ps prior to evaporation. After total power dissipation reaching its maximum at $R_S=R$, the region with further increasing power dissipation dp/dt>0 shrinks towards the centre. (C) Progression of the radial temperature distribution prior to evaporation, Δt=62 ps. Except for very narrow T-profiles <10 nm, heat conduction has no influence on temperature distribution. Also, heat capacity ρc has no significant effect on the final temperature distribution; the T-profile is mainly determined by E and the material parameter $\sigma(T)$. The width of the T-profile correlates inversely to the activation energy W (Eq. 2, see further below).

FIG. 3

(A) Radial temperature profile modelled at evaporation onset (3000 K) as function of R. The extension of the molten core ($T>T_m$) corresponds to the final hole diameter. (B) The hole diameter, determined by SEM and conductivity measurements (70 mM NaCl, (28)), as function of the series resistance R ($U_0$=10 kV, C=33 pF, h=150 μm, Schott D263T glass; SD, N=12). Small differences in hole diameter in comparison to (A) are mainly attributed to deviations in material parameters. Holes were further widened by increases in $U_0$ and C providing a larger voltage across the substrate and therefore weaker focussing (29). (C) SEM image of hole in 150 μm thick glass substrate ($U_0$=10 kV, R=1 kΩ). Material expelled from the interior was partly deposited on the substrate surface forming filamentous structures. Vertical cut reveals the cylindrical inner shape of the hole.

FIG. 4

Very small holes were produced by iterative substrate removal. (A) Alternating voltage application (upper trace, total 185 ms) induced electric arc formation, visible as current spikes in the I-t diagram (lower trace), prior to resistive heating and evaporation. The maximum energy available for evaporation was $\approx(\pi U_{prim})^2/8\omega^2 L$, $U_{prim}$=12 V and L=120 μH. A current trigger T (Inset) interrupted voltage application (delay 1-10 μs) after reaching a preset current amplitude of 50-500 mA indicating resistive heating (amplitude clipped). SEM images showing (B) surface structures with 150 nm hole in the centre after hole formation in 50 μm glass substrate, (C) magnification of the hole entrance in (B). Moreover reference is made the following specific embodiments and simulations which are given to illustrate not to limit the present invention.

SPECIFIC EMBODIMENTS

The formation of holes with very large aspect ratios in amorphous dielectrics has remained a challenging task which is only inadequately addressed with existing methods (1, 2). To overcome current limitations arising from e.g. diffraction and etching artefacts, we studied mechanisms in which the dielectric substrate itself focusses and guides the ablation process. Generally, such mechanisms necessitate appropriate non-linear material properties as demonstrated with e.g. deep laser ablation (3, 4). Fast resistive heating presents another basic mechanism, utilizing the ubiquitous exponential temperature dependency of the electrical conductance of dielectrics. The strong non-linearity and the absence of diffraction effects suggested the achievement of small structural dimensions in a large variety of insulating materials.

Simple realisations of this principle are used for the perforation of thin (h<100 μm) polymer substrates. The material is placed between two electrodes and an electric potential U>>1 kV is applied. With usually more mobile charge carriers in the air gaps between substrate and electrodes than in the polymer itself, a specific power dissipation $p_{in}=\sigma E^2=\sigma(U/t))^2$ (1) is induced inside homogeneous substrates. However, common structural defects and material inhomogeneities cause local domains with increased power dissipation (5). Elevated heat production and raise in conductivity $\sigma(T)$ engage in a positive feedback loop in these areas, leading to substrate melting, evaporation or decomposition and the formation of holes of coarsely defined dimensions. This classic approach is restricted to relatively large holes with small aspect ratios in polymers and has a strongly limited reproducibility of hole location and size.

In particular technologically interesting dielectrics with only minor defects and high resistivity and transformation temperatures have not been amenable to electric perforations. In absence of local distortions these insulators tend to resist strong electric fields without significant power dissipation, e.g. E≈100 kV/mm for common glass and 300 kV/mm for fused silica (6). The upper limit of the applicable field strength is determined by field induced mechanical tensions inside the substrate (7). With $s=\in E^2/2$ describing the mechanical tensions imposed by the electric field (Maxwell stress tensor (8)), $E>E_{critical}=(2s_{critical}/\in)^{1/2}$ leads to inelastic charge displacement. The resulting material dislocations cause unpredictable irregular fractures of macroscopic dimensions (9).

The perforation criteria $E_{min}<E<E_{critical}$, where $E_{min}$ is the minimum field strength required for self-accelerating resistive heating, excludes most amorphous dielectric materials under ambient conditions. The only route to lower $E_{min}$ below $E_{critical}$ for these materials is an augmentation of the substrate conductivity (Eq. 1). Suitable methods include irradiation, doping and heating. For its simplicity and controllability a heat source was chosen and implemented by combining the cathode with a small heating filament (FIG. 1A) (10). Confinement of the heated substrate area suggested further the precise lateral definition of the hole position.

In a directed electric field, the conductance of dielectrics depends strongly on temperature (11), $\sigma\sim\exp(-W/kT)$ (2), with an activation energy W≈1 eV for glass (12). Changing the substrate temperature from an initial value $T_0$ to $T_1$ changes the conductance and power dissipation (Eq. 1) by a factor $\exp((T_0^{-1}-T_1^{-1})W/k)$. For example, heating a glass substrate at E=const. from room temperature to 700 K induces the same power dissipation as an increase of E by five orders of magnitude at constant temperature. The hole formation process was consequently initiated by application of a directed electric field $E_{min}(T_1)<E<E_{min}(T_o)<E_{critical}$ and subsequent initial shift of $T_0\rightarrow T_1$ by auxiliary heating $p_{aux}$ (FIG. 1B).

Figure 2:
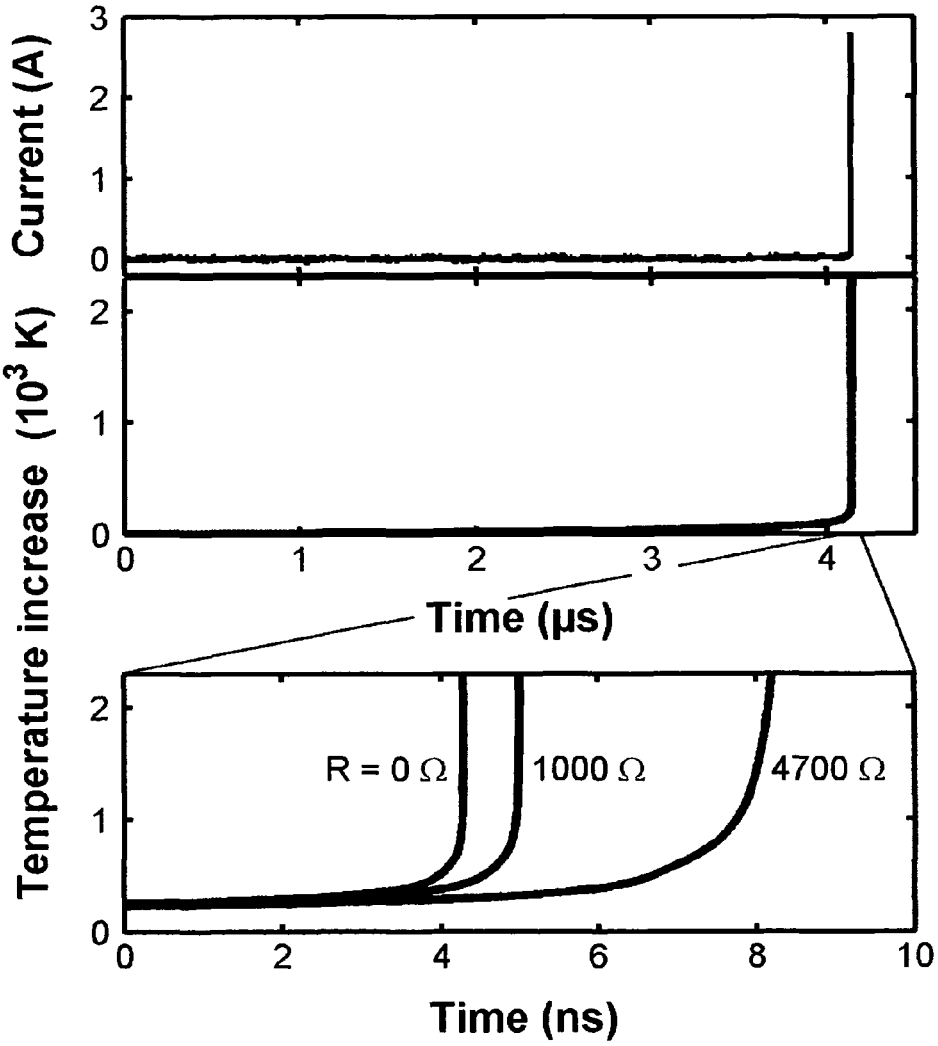
Figure 2:
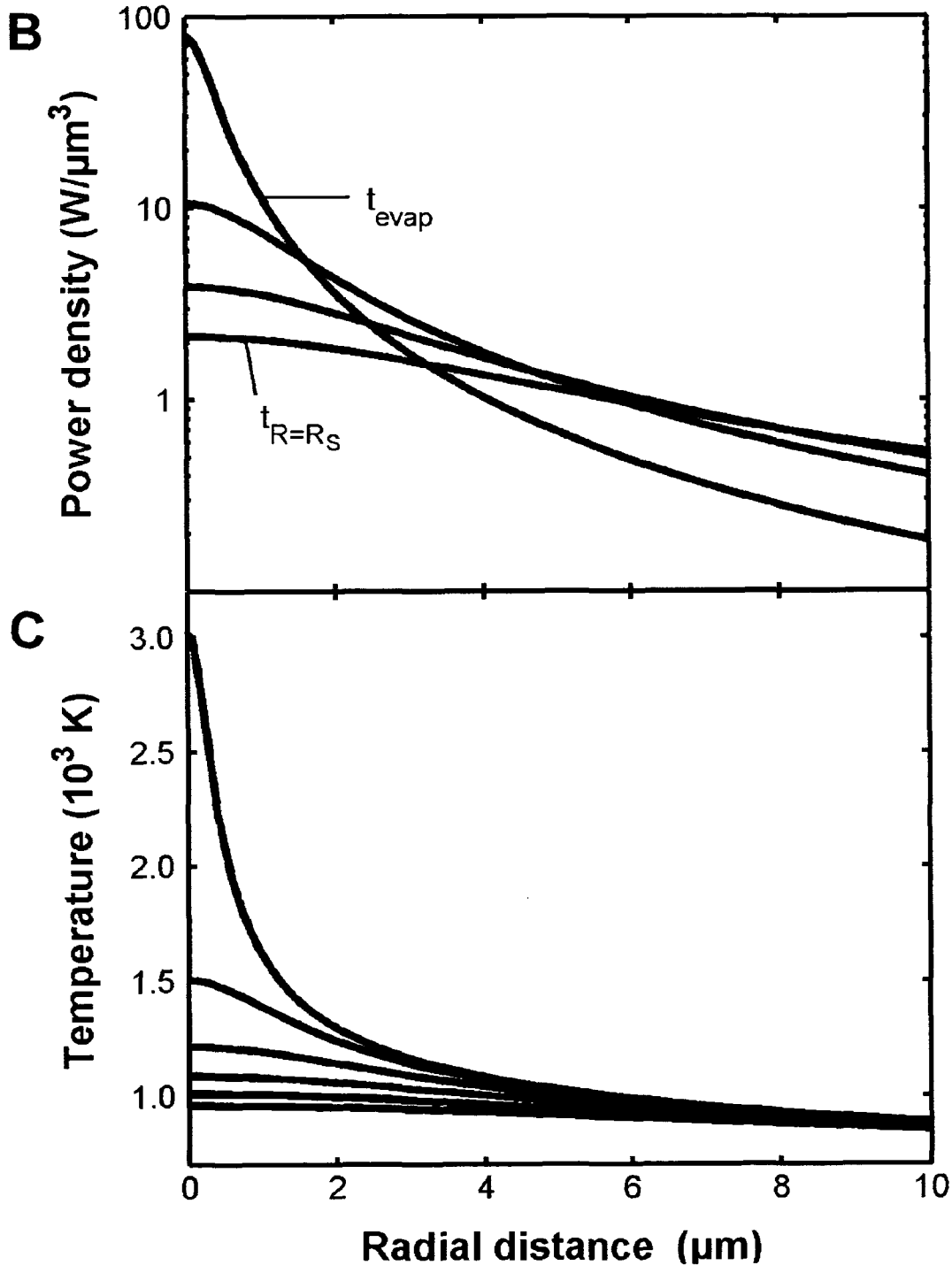

The temporal and spatial evolution of the substrate temperature was modelled using the caloric balance equation $dq/dt\equiv d(c\rho T)/dt=p_{in}-p_{out}$ (3); c is the specific heat capacity and ρ the mass density of the substrate material. To simplify the analysis of Eq. 3, heat transfer through the substrate surface was neglected for geometrical reasons (high aspect ratio). Also thermal radiation (Stefan-Boltzmann's law) was considered insignificant within the relevant temperature range, i.e. up to the evaporation point. Thus specific heat loss $p_{out}$ was approximated by heat conduction inside the substrate, turning Eq. 3 into a radial symmetrical heat conduction equation with sources, $d(c\rho T)/dt-\mathrm{div}(\lambda\ \mathrm{grad}\ T)=\sigma(T)E^2+p_{aux}$ (4), λ being the (weakly) temperature-dependent thermal conductivity (13)(14). The positive feedback between temperature and electric conductivity (Eq. 2, 4) leads to a fast hyper-exponential temperature increase in the process centre (FIG. 2A) (15, 16). Numerical analysis of Eq. 4 indicated extremely high power densities and maximum temperature gradients before substrate evaporation peaking at ≈100 W/μm$^3$ and $4\times10^{13}$ K/s, respectively (FIG. 2B).

Figure 3:
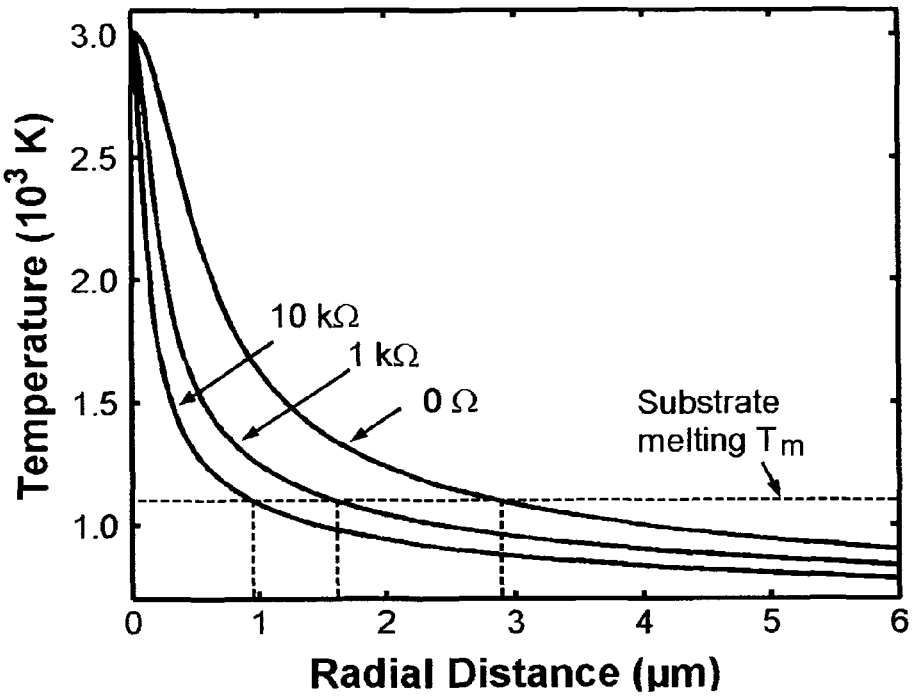
Figure 3:
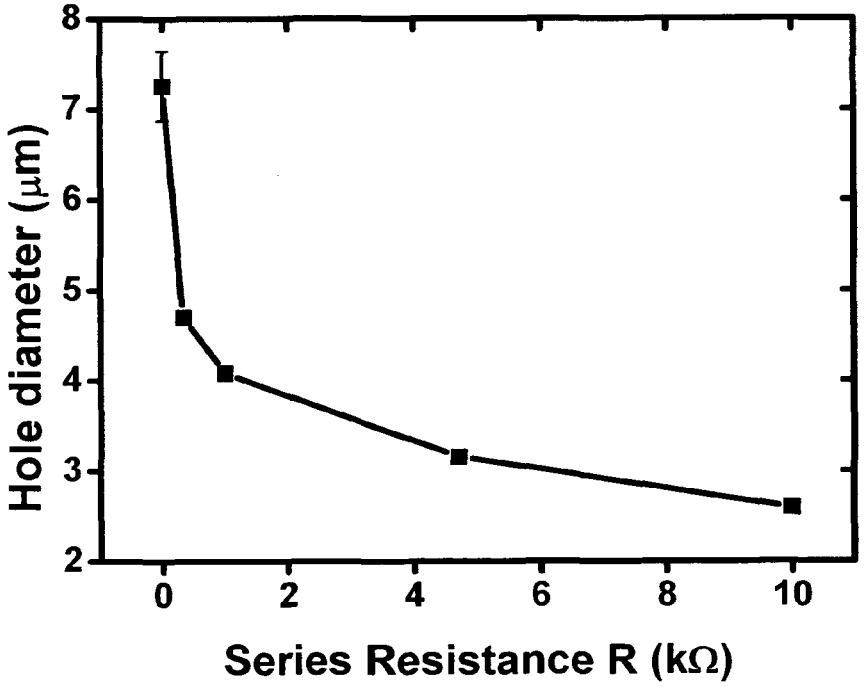
Figure 3:
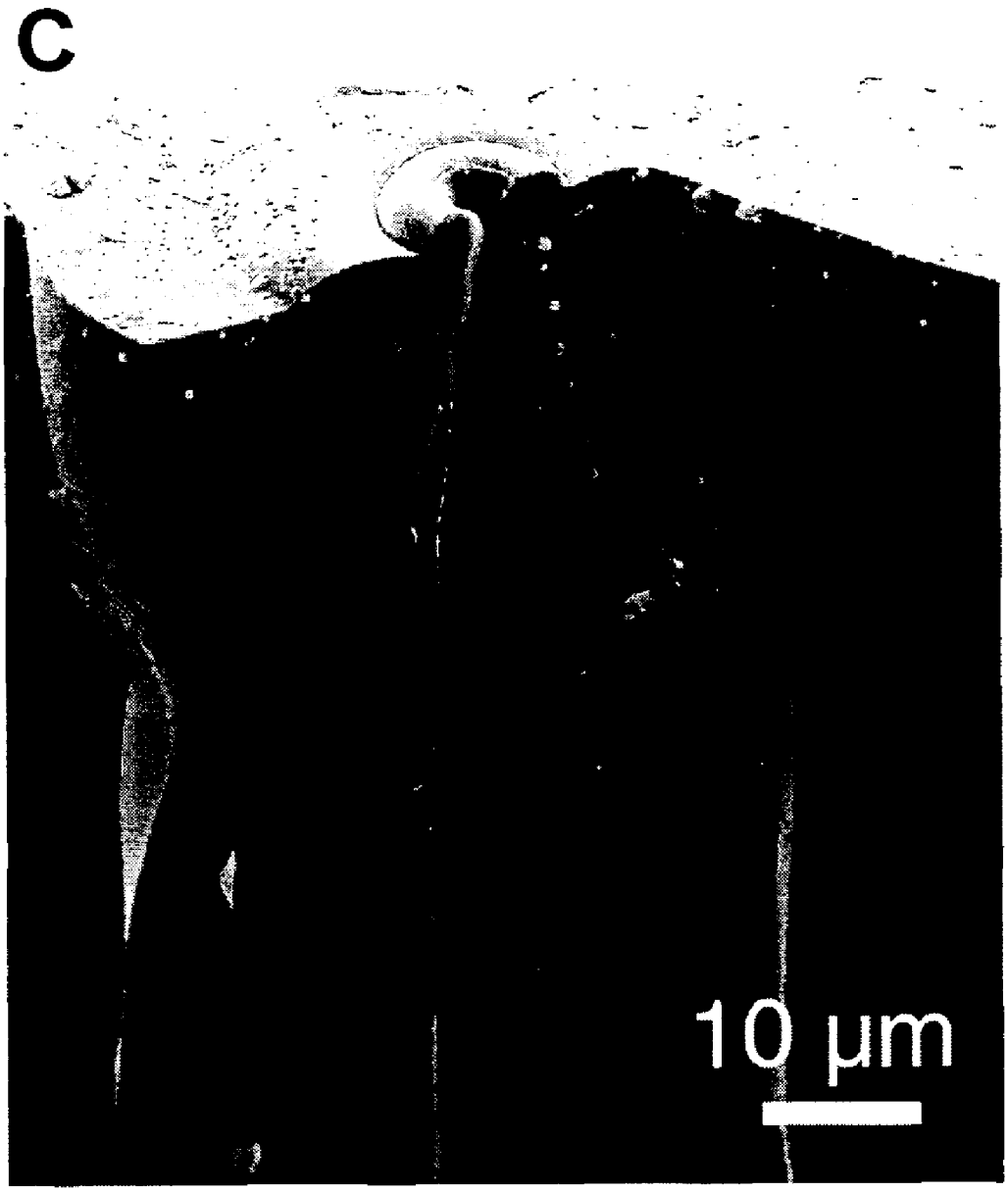

Establishing a defined and reproducible hole formation process demands strict control over the temporal and spatial temperature development. For a given material this was achieved by a defined substrate temperature-dependent reduction of the electric field E during the process (Eq. 4). Because of the substrate resistance $R_S=\int(\int\sigma dA)^{-1}dh$ being strongly dependent on T (Eq. 2), an additional ohmic resistance R in series to $R_S$ (FIG. 1A) provided the necessary feedback mechanism ('voltage divider rule') between T and E (17). While R had no significant influence on the process start ($R \ll R_S(T)$), with progressing substrate temperature and attenuating $R_S(T)$ the electric field E across the substrate reduced by a factor $1/(1+R/R_S(T))$ (5). Thus temperature growth accelerated only where this reduction was compensated by a concurrent increase in $\sigma(T)$ of at least $(1+R/R_S(T))^2$ (Eq. 1). Since $\sigma(T)$ increased towards the centre of the hot region—whose initial and only weakly shaped T-profile was established by the auxiliary heat source—this caused an inward shift of the area with advancing heat production ('electrothermal selffocussing', FIG. 2B, C). To control the magnitude of this shift and therefore the width of the temperature profile the series resistance R was made tuneable. An increase in R led to a stronger field reduction factor and focussing effect resulting in a narrower temperature profile (FIG. 3A).

In the presence of large series resistances, e.g. R>2 kΩ for h=150 μm borosilicate glass, the degree of selffocussing and consequently the temperature profile was nearly independent of the substrate thickness h. This invariance was caused by the substrate resistance $R_S$ falling significantly below R within the perforation process: for the substrate current $I \sim 1/(R+R_S) \approx 1/R$ the RC circuit became a quasi current source and therefore $p_{in}$ independent of h.

Progression of the inner core above evaporation temperature initiated the formation of holes. The extremely fast heating (FIG. 2A, C) and relating thermal pressure build-up at evaporation onset drove molten material completely out of the substrate. Consequently, the hole diameter was determined by the extension of the molten substrate area ($T \geqq T_m$) at evaporation onset. As the width of this area was controlled by the series resistance R, the hole diameter was a function of R (FIG. 3A). The high substrate conductance after hole formation led to a fast discharge of capacitors C<500 pF with apparently negligible hole widening artefacts.

Testing the method on borosilicate glass slides of h=30-1000 μM thickness, the hole diameter could be adjusted between d=2.6-10.6 μm varying R=0-10 kΩ ($U_0$=10-20 kV, C≦470 pF) (FIG. 3B), which was in good agreement with simulations (FIG. 3A). Additional changes of the substrate thickness caused only small variations of the hole diameter. However, an increase of the substrate thickness h reduced the maximal useable resistance R ($U_0$=const), thereby raising the minimum hole diameter $d_{min}$ (e.g. $d_{min}$=5 μm for h=1000 μm) and limiting the maximum aspect ratio to ~200. This effect originated in $R_S \sim h$ and therefore in a lowered specific power dissipation $P/h \sim 1/(R+R_S)^2$ with increasing thickness (18). While for perforations with $R_S(T_{evap}) \ll R$ the effect was marginal (current source condition), increasing the substrate thickness so that $R_S(T_{evap}) \rightarrow R$, the power loss needed to be compensated by a reduction of R; otherwise incomplete holes were obtained, closed by partially not expelled material. Variations of the hole diameter at constant electrical parameters were <5% SD; the reproducibility was degraded in absence of the series resistance (R<<100Ω) to errors up to 30% SD owing to an ill-defined focussing mechanism.

Interestingly, for substrates h<50 μm a decoupling of the perforation process from series resistance control was observed. Here the energy stored across the substrate $C_S U^2/2$>100 μJ was sufficient for complete perforation. Thin substrates therefore required an appropriate reduction of $C_S$ (e.g. by restriction of the open surface) to avoid excessive parasitic energy storage and to enable process control by R. The discharge driven by $C_S$ may however provide an efficient tool for studies of high temperature micro plasmas. The lack of inductive components and the short discharge distance enable an extremely fast discharge process approaching most likely theoretical values given above (FIG. 2B, C).

Holes formed under all process conditions had a circular shape and were surrounded by a concentric bulge of substrate material (FIG. 3 C), whose extension varied with R and the voltage application time after hole formation. To exclude an influence of the initial conditions on the hole properties, initialization parameters were varied over a wide range, including the substrate distance of the heating filament (50-500 μm) as well as its size and temperature (1000-1600 K). Differences became only apparent in the time interval required for 'ignition', ranging from ~20-650 ms (h=150 μm). The observed invariance of the hole properties was attributed to two mechanisms: (I) Longitudinal temperature gradients existing initially within the process centre were rapidly equilibrated by a shift of the electric field (and therefore power dissipation) to less conducting and colder regions. (II) Initially existing lateral temperature profiles (providing $T_{max} \ll T_m$) evolved rapidly into a form only governed by R, caused by the strong imbalance between heat dissipation and heat conduction $P_{in} \gg P_{out}$, e.g. $P_{in}(T_m)/P_{out}(T_m) \approx 10^6$ (FIG. 1B).

Based on the process invariance towards the initialization conditions an enhanced definition of the hole location was addressed using focussed Laser radiation, replacing the heating filament as source for process initiation. The method was tested on borosilicate glass and fused silica (h=100 μm) substrates using a 4.5 W $CO_2$ Laser (Model 25WA, TS Team Inc.) with 2 mm spot size for 200-1000 ms. The observed positioning error, determined as displacement between the centres of the focal spot and the hole, was below 90 μm (<4.5% focal size). This relatively tight correlation, even for the employed very large focal spot, was attributed to a significant temperature increase towards the focal centre (1). The use of more focussed laser beams suggests a further significant reduction of the absolute positioning error.

A key characteristic of hole formation processes is the obtainable minimum hole diameter. Simulations based on Eq. 4 and an ideal RC circuit (FIG. 1A, $C_S$=0) suggested for thin substrates possible hole dimensions d<10 nm (R>1 MΩ, h=100 nm). Experimentally, these structures were difficult to reproduce, in particular because of $C_S$ growing linearly with decreasing thickness of unshielded substrates, which made the necessary avoidance of parasitic energy storage across the substrate difficult and therefore series resistance control inefficient.

Consequently an adapted approach was developed for the production of holes in the sub-micrometer range, based on the iterative removal of substrate material. Controlled discrete discharge steps were applied in a sequence that converged the forming structure towards the desired dimensions. During each step the amount of substrate material removed was defined by the energy available for evaporation. The required fast and continuous energy adjustment was provided by replacing the original C-buffered voltage source with a high voltage-high impedance AC transformer (FIG. 4A). The maximum energy stored inside the transformer (and in part across the substrate) was frequency-dependent $\sim 1/\omega^2$ (FIG. 4A) and determined by appropriate modulation of the primary voltage.

The usage of alternating voltages with frequencies ω>30 kHz provided also an intrinsic process initiation, which allowed to eliminate auxiliary heat sources. The initial temperature shift was mediated by short lived electric arcs between the substrate surface and the electrodes accompanying the frequency-dependent capacitive charging and discharging of the substrate. Simultaneous heat transfer into the substrate raised locally the substrate temperature within ≈0.01-5 s above the temperature required for resistive heating (FIG. 1B). The duration of this initialisation phase was a function of substrate parameters and voltage (FIG. 4A).

Hole formation started as described before; however, correlating with the energy stored (typically <50 μJ) the evaporation pressure caused only a fraction of the molten material to be expelled. Due to the high source impedance and lack of energy storage across the hot (conductive) substrate, the limited electric power provided by further voltage generation was not able to increase evaporation pressures but resulted in melting of larger substrate areas. To prevent the corresponding distortion of the newly formed cavity, voltage generation was immediately turned off after evaporation. After cooling of the substrate below the temperature required for resistive heating, thus allowing again for energy storage across the transformer and substrate, voltage generation for a new discharge step was restarted.

Figure 4:
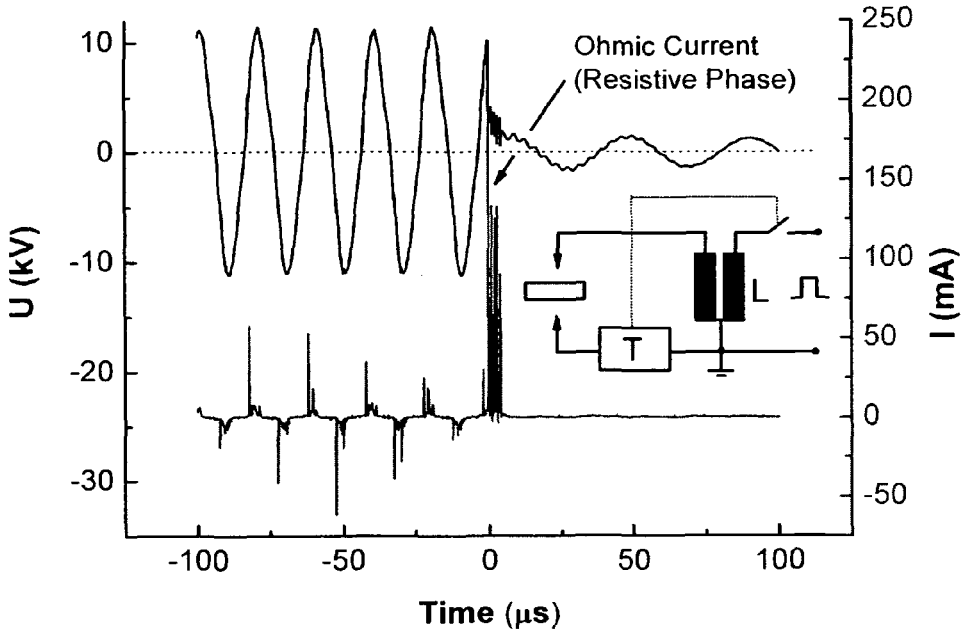
Figure 4:
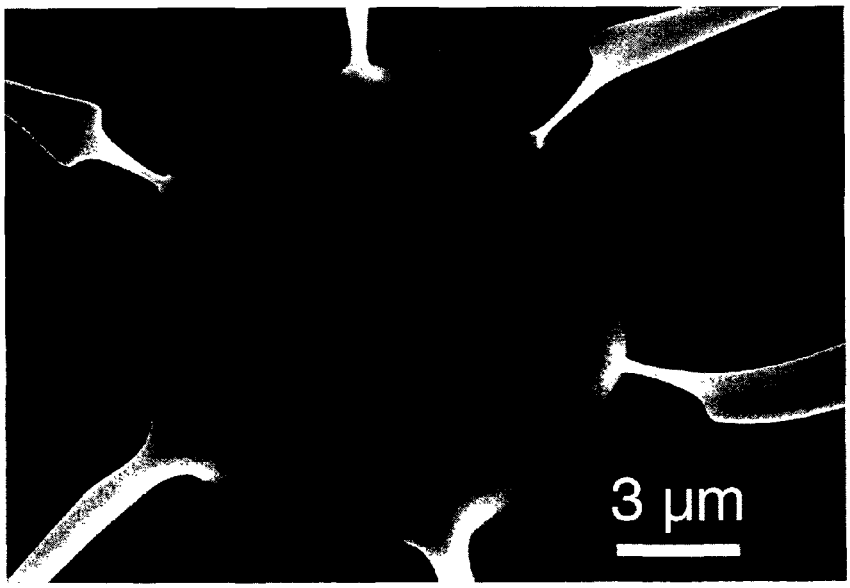
Figure 4:
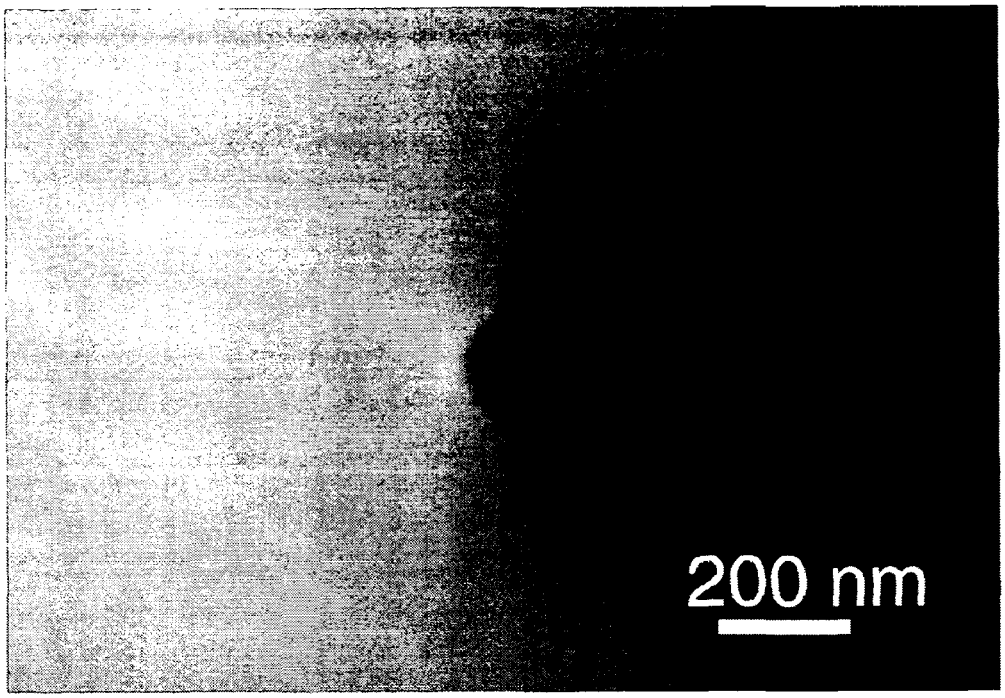

Iterative application of these steps produced holes of 0.1-7 μm in diameter in glass substrates of 30-1000 μm thickness (FIG. 4 C). A maximum aspect ratio of 330 was obtained in 50 μm thick glass slides. The shape and diameter of the hole were determined by the energy stored during each step, which was a function of voltage amplitude and frequency (FIG. 4A), the duration of the resistive heating phase, which was controlled by the trigger circuit, and the number of steps. Both, frequency (e.g. ω=300→150 kHz) and trigger delay were adjusted for every step. Cooling intervals within one series of discharge steps were on the order of 100 ms; significant extension of these intervals led to substrate fractures. The control of the hole diameter over almost 2 orders of magnitude by continuously adjustable 'soft' parameters not requiring hardware changes appears attractive for practical applications. Additionally, the use of alternating voltages prevented high voltage flashovers bypassing the substrate, allowing for small distances between adjacent holes.

Two paradigmatic applications of the described hole formation process were demonstrated for chip-based analysis systems. First we tested electroosmotic flow in 150-1000 μm thick glass substrates with holes of 1-7 μm in diameter as a potential building block of fL/pL-fluid systems in which aqueous fluids are directly pumped between the two sides of the chip (19-21). Using a setup described in (22) and applying e.g. a voltage of 5 V across 150 μm glass substrates with unmodified 5 μm holes and filled with 0.05 M NaCl solution (pH=8.85) produced a flow of about 200 μm/s as measured by tracking 419/600 nm beads. Artefacts arising from parasitic Joule heat (≈1.5 μW) and gas bubble formation were not observed. Based on the same principle, a simple particle collector was build using holes with a funnel-like entrance and a diameter $d<d_{particle}$. Voltage reversal fully released collected particles. The combination of electroosmotic flow and low driving voltage enables also a simple interfacing and integration of electronic and microfluidic components and on a single chip.

Perforated borosilicate slides (h=150 μm, d=1-4.2 μm) were further tested for cell adhesion, providing a possible substitute for typical glass-pulled patch clamp pipettes (22, 23). Non-transfected and trypsinized cells (CHO, HEK293, Jurkat) adhering to the glass substrate produced typical seal resistances between 2-100 GΩ in normal physiological solution in more than 60% of all trials. Reproducibility and magnitude of seal resistances indicated a very low roughness of the surface surrounding the hole (24). In addition to the unusually high seal success rate, the very low capacitance of the substrate <1 pF, sandwiched between the two buffer compartments (contact surface ≈2 $mm^2$), allowed for very low noise single channel recordings comparable to difficult to use PDMS coated pipettes (24). Simple to manufacture glass substrates with multiple holes can provide the basis for automated patch clamp systems with high data quality.

Electrothermal-Selffocussing presents a fundamental method for fast and strongly localized heating in dielectric materials that can be advanced in a variety of directions; one is the further reduction of the hole size by an expected factor of 10-100 using thin substrates. The highly confined, extremely fast and partially quasi-adiabatic discharge process itself appears of interest for studies of relatively dense and hot plasmas (25).

The features of the present invention disclosed in the specification, the claims and/or in the accompanying drawings, may, both separately, and in any combination thereof, be material for realizing the invention in various forms thereof.

REFERENCES AND NOTES

1. M. J. Madou, Fundamentals of Microfabrication: The Science of Miniturization (CRC Press, 2002).
2. D. R. Reyes, D. Iossifidis, P. A. Auroux, A. Manz, *Anal. Chem* 74, 2623-2636 (2002).
3. Y. R. Shen, The Principles of Nonlinear Optics (John Wiley & Sons, 2002).
4. H. Varel, D. Ashkenasi, A. Rosenfeld, M. Wähmer, E. E. B. Campbell, *Applied Physics A: Materials Science & Processing* 65, 367-373 (1997).
5. M. S, Naidu and V. Kamaraju, High Voltage Engineering (McGraw-Hill, 1996).
6. K. Kühne, Werkstoff Glas (Akademie-Verlag, Berlin, 2007).
7. L. D. Landau and E. M. Lifshitz, Course of Theoretical Physics: Electrodynamics of Continuous Media, Vol. 8, 1968).
8. J. D. Jackson, Classical Electrodynamics (Wiley, New York, ed. 3, 1999).
9. B. Tareev, Physics of dielectric materials (Mir, Moscow, 1975).
10. Materials and methods are available as supporting material on Science Online.
11. J. J. O'Dwyer, The theory of electrical conduction and breakdown in solid dielectrics (Clarendon Press, 1973).
12. N. P. Bansal and R. H. Doremus, Handbook of Glass Properties (Academic Press, 1986).
13. J. Zarzycki, Glasses and Amorphous Materials (VCH, 1991).
14. A voltage drop between substrate and electrodes was neglected for the large difference in conductive cross-section of >1000 and high electrical conductivity within this region. A noticable voltage drop occurred only near the interface to the hole forming substrate region.
15. S, N. Ivanov, E. A. Litvinov, V. G. Shpak, *Technical Physics Letters* 32, 745-749 (2006).
16. J. Hendriks and G. J. H. Brussaard, *Pulsed Power Conference,* 2003. *Digest of Technical Papers. PPC*-2003. 14*th IEEE International* 1, (2003).
17. With LdI/dt<<IR the inductance L of the circuit became irrelevant for the hole formation process. The circuit impedance Z was determined by R.
18. A higher or more sustained evaporation pressure required for material ejection in thicker substrates may further contribute to this effect.
19. P. A. Auroux, D. Iossifidis, D. R. Reyes, A. Manz, *Anal. Chem* 74, 2637-2652 (2002).
20. B. He, N. Tait, F. Regnier, *Anal. Chem* 70, 3790-3797 (1998).

21. G. J. Bruin, *Electrophoresis* 21, 3931-3951 (2000).
22. C. Schmidt, M. Mayer, H. Vogel, *Angew. Chem. Int. Ed Engl.* 39, 3137-3140 (2000).
23. O. P. Hamill, A. Marty, E. Neher, B. Sakmann, F. J. Sigworth, *Pflügers Archiv European Journal of Physiology* 391, 85-100 (1981).
24. B. Sakman and E. Neher, Single-Channel Recording (Plenum, New York, 1983).
25. I. V. Kurchatov, *Nucleonics* 14, 37-42 (1956).
26. D. A. Frank-Kamenetskii, Diffusion and Heat Exchange in Chemical Kinetics (Princeton University Press, 1955).
27. L. D. Landau and I. M. Lifschitz, Course of Theoretical Physics: Hydrodynamics (Pergamon Press, New York, 1958).
28. B. E. Conway, Electrochemical data (Elsevier, 1952).
29. Additional hole widening was observed during prolonged voltage application after hole formation and accompanying repetitive capacitor discharges. Diameter increases were limited to ~30% by substrate fractures.

The invention claimed is:

1. A method of introducing a structure, preferably a hole or cavity or channel or well or recess, in a region of an electrically insulating substrate, said method comprising the steps:

a) providing an electrically insulating substrate, b) storing electrical energy across said substrate using an energy storage element which is charged with said electrical energy, said amount of electrical energy being in the range of from 1-50000mJ/mm substrate thickness, said energy storage element being electrically connected to said substrate, said electrical energy being sufficient to significantly heat, and/or melt and/or evaporate parts or all of a region of said substrate, c) applying additional energy, preferably heat, to said substrate or a region thereof to increase the electrical conductivity of said substrate or said region thereof, and thereby initiate a current flow and, subsequently, a dissipation of said stored electrical energy within the substrate, and d) dissipating said stored electrical energy, wherein the rate of dissipating said stored electrical energy is controlled by a current and power modulating element, said current and power modulating element being part of the electrical connection between said energy storage element and said substrate.

2. The method according to claim 1, wherein step b) is performed by applying a voltage across said region of said substrate by means of a voltage supply and charging said energy storage element with said electrical energy, said energy storage element being electrically connected in parallel to said substrate and said voltage supply.

3. The method according to claim 2, wherein said energy storage element and, preferably also said voltage supply, is connected to said substrate by electrodes, which electrodes either touch said substrate or touch a medium, said medium being in contact with said substrate, wherein said medium is a liquid or gaseous medium which is electrically conducting or can be made electrically conducting.

4. The method according to claim 3, wherein said energy storage element and said voltage supply are connected to said substrate by the same electrodes.

5. The method according to claim 2, wherein the amount of said electrical energy stored across said substrate and charged to said energy storage element is user-defined in relation to substrate parameters, such as substrate area, substrate thickness, and process parameters, such as maximum temperature occurring during step d).

6. The method according to claim 5, wherein said voltage supply is a high impedance voltage supply, wherein preferably said high impedance voltage supply has an impedance >10 kΩ, more preferably >100 kΩ and, even more preferably >1 MΩ.

7. The method according to claim 5, wherein said energy storage element is a low impedance energy storage element, wherein preferably said low impedance is an impedance ≦10kΩ.

8. The method according to claim 2, wherein, upon dissipation of said electrical energy, said voltage supply provides further electrical energy to be stored across the substrate by charging it to said energy storage element.

9. The method according to claim 8, wherein steps b) - d) are repeated at least once, with a user-defined delay after the end of step d) and before performance of a next step b).

10. The method according to claim 1, wherein said dissipation of said electrical energy in step d) occurs by an electrical current being supplied from said energy storage element to said substrate and through said region and thereby transforming said electrical energy into heat which heat will heat and/or melt and/or evaporate and/or ablate substrate material in said region.

11. The method according to claim 10, wherein said electrical current is supplied to said substrate via said current and power modulating element, said current and power modulating element controlling and/or modulating step d), and thereby controlling the transformation of said electrical energy into heat.

12. The method according to claim 11, wherein said electrical current being supplied to said substrate and subsequently flowing through said substrate in step d) has a temporary maximum of at least 100 mA for substrates of >0.1 mm thickness, if introduction of a hole into said substrate is required.

13. The method according to claim 10, wherein said dissipation in step d) occurs at a stored electrical energy resulting in a trans-substrate voltage across said substrate of at least 5V/micrometer substrate thickness.

14. The method according to claim 11, wherein said current and power modulating element is an electronic feedback mechanism which, preferably, comprises a current and/or voltage analysis circuit such as a trigger circuit alone or as part of a user programmed device, such as a computer, said current and/or voltage analysis circuit preferably being capable of controlling the trans-substrate voltage and electrical current flow of step d) according to user-predefined procedures, such as steadily reducing or turning off such voltage supply and/or energy storage element output once a user specified trans-substrate current threshold is exceeded.

15. The method according to claim 1, wherein said additional energy, preferably heat, originates either from an additional energy source, preferably a heat source, or from performing step b) on said substrate.

16. The method according to claim 15, wherein said additional energy source is a heated electrode or a heating element placed near by said substrate or a laser or other focussed light source or a gas flame.

17. The method according to claim 14, wherein said current and/or voltage analysis circuit also is capable of controlling said additional energy or heat source, if present.

18. The method according to claim 14, wherein said electronic feedback mechanism is an ohmic resistor which is connected in series between said substrate and said energy storage element.

19. The method according to claim 18, wherein said ohmic resistor is chosen such that it has a resistance in the range of from 0.01-100 kΩ if said substrate has a thickness ≧1μm , and a resistance >100 kΩ if said substrate has a thickness <1μm.

20. The method according to claim 18, wherein said ohmic resistor is chosen in terms of its resistance such that said resistor leads to a reduction of the trans-substrate voltage of at least a factor of 2, preferably a factor of 5during step d), compared with otherwise identical conditions but in the absence of a resistor.

21. The method according to claim 18, wherein said ohmic resistor is tunable.

22. The method according to claim 18, wherein said ohmic resistor has a fixed resistance.

23. The method according to claim 1, wherein said energy storage element and, preferably also said voltage supply, is connected to said substrate by said electrodes via connections, which, with the exception of said ohmic resistor, if present, have a low impedance which low impedance connections are chosen such in terms of their total impedance value that they do not lead to any significant reduction of the trans-substrate voltage during step d), wherein, preferably said low impedance connections have a total impedance value ≦0.01kΩ.

24. The method according to claim 1, wherein said current and power modulating element causes an end of step d) within a user-predefined period after onset of step d), said onset preferably being an increase in electrical current, by a factor of 2, preferably by at least one order of magnitude, or a current value >1mA, preferably >10mA.

25. The method according to claim 2, wherein said energy storage element being electrically connected in parallel to said substrate and said voltage supply is a capacitor or a coil.

26. The method according to claim 25, wherein said energy storage element is a capacitor.

27. The method according to claim 26, wherein said capacitor has a capacity in the range of at least 30 pF/mm substrate thickness.

28. The method according to claim 27, wherein said capacitor is connected to said substrate via said current and power modulating element, preferably via said ohmic resistor, such that said electrical energy stored using said capacitor, is dissipated via said current and power modulating element, preferably via said ohmic resistor.

29. The method according to claim 3, wherein said energy storage element is an intrinsic or intrinsically forming capacitance of said substrate which is the sole energy storage element present or is present in addition to a capacitor as defined in any of claims 26-28.

30. The method according to claim 29, wherein, if said intrinsic or intrinsically forming capacitance of said substrate is the sole energy storage element present, no electrodes connecting said energy storage element to said substrate are present, and step d) is controlled by appropriate selection of the area of said substrate which area is exposed to the surrounding medium, and/or by appropriate selection of the conductive properties of said medium being in contact with said substrate, said medium being responsible for charge carrier transport during said dissipation in step d), said conductive properties of said medium being defined by pressure, temperature, and composition of said medium, said medium thereby functioning as current and power modulating element.

31. The method according to claim 3, wherein step b) occurs by the placement of said electrodes at or near said region, preferably by placing one electrode on one side of said substrate and by placing another electrode on another side of said substrate, and by application of said voltage across said electrodes.

32. The method according to claim 1, wherein said applied voltage is purely DC.

33. The method according to claim 1, wherein said applied voltage is purely AC.

34. The method according to claim 1, wherein said applied voltage is a superposition of AC and DC voltages.

35. The method according to claim 33, wherein the frequency of said applied AC voltage is in the range of from $10^2$ to $10^{12}$ Hz, preferably in the range of from $5\times10^2$ to $10^8$ Hz, more preferably $1\times10^3$ to $1\times10^7$ Hz.

36. The method according to claim 33, wherein said AC voltage is applied intermittently, preferably in pulse trains of a duration in the range of from 1 ms to 1000 ms, preferably 10 ms to 500 ms, with a pause in between of a duration of at least 1 ms, preferably of at least 10 ms.

37. The method according to claim 33, wherein said applied AC voltage is used for performing step c).

38. The method according to claim 33, wherein said applied AC voltage has parameters e.g. amplitude, frequency, duty cycle which are sufficient to establish an electric arc between a surface of said substrate and said electrodes, wherein, preferably, said electric arc is used for performing step c).

39. The method according to claim 33, wherein said applied AC voltage leads to dielectric losses in said region of said substrate, said dielectric losses being sufficient to increase the temperature of said region.

40. The method according to claim 33, wherein the frequency of said applied AC voltage is increased to reduce deviations of the current path from a direct straight line between the electrodes.

41. The method according to claim 33, wherein the frequency of said applied AC voltage is increased to minimize the possible distance between neighbouring structures, preferably neighbouring holes.

42. The method according to claim 1, wherein in step c), heat is applied to said region of said substrate using a heated electrode or a heating element placed near by the electrode.

43. The method according to claim 41, wherein said heated electrode is an electric heating filament and is also used to apply said voltage to said region in step b).

44. The method according to claim 1, wherein, in step c), heat is applied to said region of said substrate additionally or only by using an external heat source, such as a laser or other focussed light source, or by using a gas flame.

45. The method according to claim 1, wherein, in step c), heat is applied to said region of said substrate by applying an AC voltage to said region.

46. The method according to claim 45, wherein said AC voltage is applied to said region by said electrodes placed on opposite sides of said substrate, preferably at least one electrode being placed on one side of said substrate and at least one electrode being placed on another side of said substrate.

47. The method according to claims 46, wherein said electrodes placed on opposite sides of said substrate are also used for performing step b).

48. The method according to claim 47, wherein said AC voltage is in the range of $10^3$ V-$10^6$ V, preferably $2\times10^3$V-$10^5$V, and has a frequency in the range of from $10^2$ Hz to $10^{12}$ Hz, preferably in the range of from $5\times10^2$ to $10^8$ Hz, more preferably $1\times10^3$ to $1\times10^7$ Hz.

49. The method according to claim 1, wherein said structure being formed is a hole having a diameter in the range of from 0.01 μm to 200 μm, preferably 0.05 μm to 20 μm.

50. The method according to claim 1, wherein said structure being formed is a cavity having a diameter in the range of from 0.1 μm to 100 μm.

51. The method according to claim 1, wherein said voltage is applied by electrodes placed on opposite sides of said substrate, and said structure being formed is a channel-like structure obtained by a relative movement of said electrodes in relation to said substrate.

52. The method according to claim 1, wherein said electrically insulating substrate is selected from a group comprising carbon-based polymers, such as polypropylene, fluoropolymers, silicon-based substrates, such as glass, quartz, silicon nitride, silicon oxide, silicon based polymers, semiconducting materials such as elemental silicon.

53. The method according to claim 1, wherein said region where a structure is to be formed, has a thickness in the range of from $10^{-9}$ m to $10^{-2}$ m, preferably $10^{-7}$ m to $10^{-3}$ m, more preferably $10^{-5}$m to $5\times10^{-4}$ m, most preferably $>10^{-6}$ m.

54. The method according to claim 1, wherein said substrate is provided in step a) within a medium (solid, liquid or gas) that reacts with a surface of said substrate during steps b), c) and/or d).

* * * * *